US005368243A

United States Patent [19]

Gold

[11] Patent Number: 5,368,243

[45] Date of Patent: Nov. 29, 1994

[54] ROTARY COLLIDER MILL

[76] Inventor: James J. Gold, 1503 Front St., Needles, Calif. 92363

[21] Appl. No.: 962,362

[22] Filed: Oct. 16, 1992

[51] Int. Cl.[5] ..... B02C 13/286

[52] U.S. Cl. ..... 241/186.2; 241/189.1

[58] Field of Search ..... 241/189.1, 191, 195, 241/186.2

[56] References Cited

U.S. PATENT DOCUMENTS

| | | | |
|---|---|---|---|
| 1,424,225 | 8/1922 | Williams | 241/189.1 |
| 4,151,959 | 5/1979 | Deister | 241/189.1 X |
| 4,274,601 | 6/1981 | Musto | 241/186.2 |
| 5,178,335 | 1/1993 | Mertens | 241/189.1 X |

*Primary Examiner*—Douglas D. Watts
*Attorney, Agent, or Firm*—Skjerven, Morrill, MacPherson, Franklin & Friel

[57] ABSTRACT

An apparatus for breaking or crushing one or more objects into a plurality of smaller objects. The apparatus comprises a canister, an impeller disposed within the canister, and a means for rotating the impeller. The objects to be crushed are fed into the canister through an inlet port formed in a first side plate of the canister. The crushed objects are discharged from the canister through an outlet port formed in a second side plate of the canister. In one embodiment, the canister is formed such that the cross-sectional shape of the canister parallel to the first side plate is asymmetric with respect to the axis of rotation of the impeller. In another embodiment, the impeller comprises a plurality of blades formed with a paddle curved such that the concave end of the paddle faces into the airflow as the impeller is rotated. In yet another embodiment, the first side plate is formed opposite the second side plate so that the outlet port is on an opposite side of the canister from the inlet port. Preferably, the impeller has three blades. The outlet port or ports are preferably formed above the level of the inlet port or ports. The apparatus can crush ore having a mean diameter of 2 inches to 50 mesh particles in a matter of seconds. Better uniformity of size of discharged particles is obtained than in prior mills. The apparatus of the invention requires little maintenance since the impeller and canister interior sustain little wear or fatigue.

19 Claims, 9 Drawing Sheets

ROTARY COLLIDER MILL

BACKGROUND OF THE INVENTION

1. Field of the Invention

This invention relates to an apparatus for breaking one or more objects into a plurality of smaller objects.

2. Related Art

There are a large number of situations in which it is desired to break one or more objects into a plurality of smaller objects. For instance, in mining, it is frequently necessary to break pieces of ore into smaller pieces of ore. In the production of feed from, for example, corn, it is necessary to break kernels of corn into smaller pieces. In glass recycling, it is necessary to break bottles or other relatively large pieces of glass into smaller pieces of glass.

One means to break a plurality of objects into smaller objects is a mill. Typically, a mill comprises a chamber (having inlet and outlet ports) in which the objects are crushed, and a crushing means inside the chamber which collides with the objects to break them into smaller objects. Often, the crushing means comprises one or more hammers which are attached to and rotated by a shaft within the chamber such that the hammers smash the objects against raised surfaces (lands) formed on the chamber walls. The shaft can be either vertical or horizontal. The inlet port is typically formed in either the side or the top of the chamber. The outlet port is typically formed in either the top or bottom of the chamber.

In mills in which objects are broken into smaller objects by collision with parts of the mill (i.e., the crushing means and interior walls of the chamber), it is difficult to achieve a very small size of the discharged objects. Further, insofar as small-sized discharged objects can be produced, existing mills require a long time (hours or days) to achieve the small sizes.

In one type of mill, known as a gravity discharge mill, discharge of the crushed objects from the chamber is accomplished by gravity. Objects to be crushed are fed into the chamber through the inlet port which is formed in either the top or side of the chamber. The objects are crushed until they drop out of the outlet port formed near the bottom of the chamber. In gravity discharge mills, uniformity in size of discharged objects is poor since objects are discharged haphazardly (i.e., whenever an object happens to fall out of the outlet port), rather than according to size.

In another type of mill, the outlet port is located in the top of the chamber. The objects to be crushed are typically fed into the chamber through an inlet port formed in the side of the chamber. The objects are crushed until an impact within the chamber propels them out of the outlet port. Again, however, poor size uniformity is a problem with such mills, since objects are discharged from the chamber not according to size, but rather as matter of happenstance (i.e., when an impact propels an object in the proper direction).

In mills having the outlet port formed in either the bottom or top of the chamber, objects introduced into the chamber do not have to pass all the way across the chamber (in the horizontal direction) before being discharged. Therefore, it is difficult to efficiently crush objects into very small sizes since the objects may spend a relatively small amount of time in the chamber and receive a relatively small number of impacts.

SUMMARY OF THE INVENTION

According to the invention, an apparatus is provided for breaking or milling one or more objects into a plurality of smaller objects. The apparatus comprises a canister, an impeller disposed within the canister, and a means for rotating the impeller such as, for instance, a shaft. The impeller has at least one blade. The objects to be milled are fed into the canister through an inlet port formed in the canister. The milled objects are discharged from the canister through an outlet port formed in the canister.

In one embodiment according to the invention, the canister is formed such that the cross-sectional shape of the canister perpendicular to the axis of rotation of the impeller is asymmetric with respect to the axis of rotation of the impeller. Preferably, the canister is formed so that the cross-sectional shape of the canister perpendicular to the axis of rotation of the impeller has an area which lies outside the arc of sweep of the end of the impeller blade or blades distal from the axis of rotation of the impeller. The outlet port is formed in a side plate of the canister opposite the aforementioned area of the cross-sectional shape of the canister.

In another embodiment according to the invention, each blade or blades of the impeller comprises a pair of paddle supports and a paddle. Each of the paddle supports is attached at one end to the shaft. The paddle is attached to the other end of the pair of paddle supports. The paddle is curved such that the concave end of the paddle faces into the air flowing past the paddle as the impeller is rotated. Preferably, each pair of paddle supports, associated paddle and the shaft form a two-dimensional bounded space. Preferably, the radius of curvature of a curved surface of each of the impeller paddles is approximately 0.83 times the distance between ends of the curved surface of the paddle as measured in a straight line between ends.

In another embodiment according to the invention, the inlet port is formed through a first side plate and the outlet port is formed through a second side plate opposite the first side plate so that the outlet port is on an opposite side of the canister from the inlet port.

Preferably, in the apparatus according to the invention, the impeller has three blades. Preferably, more than one outlet port is provided. The outlet port or ports are preferably formed above the level of the inlet port or ports.

Because of the novel characteristics of the apparatus according to the invention, the objects to be milled impact each other and the impeller paddles vigorously and often, so that the objects are milled extensively. In particular, the apparatus according to the invention provides improved milling capability because the objects mill extensively to other objects in the canister as compared to prior mills in which the objects mill almost exclusively by impacting a moving part of the mill or interior walls of the milling chamber.

The apparatus according to the invention can mill ore having a mean diameter of 2 inches to 50 mesh particles in a matter of seconds. Better uniformity of size of discharged particles is obtained than in prior mills. Additionally, the use of an add-on remill circuit allows milling of particles to relatively tight size tolerances.

The apparatus according to the invention requires little maintenance. The impeller and canister interior sustain little wear or fatigue. These parts should not require repair or replacement during years of steady use. The parts most susceptible to failure are the shaft bearings which can be easily replaced since they are located outside the canister.

DETAILED DESCRIPTION OF THE PREFERRED EMBODIMENTS

Figure 1:
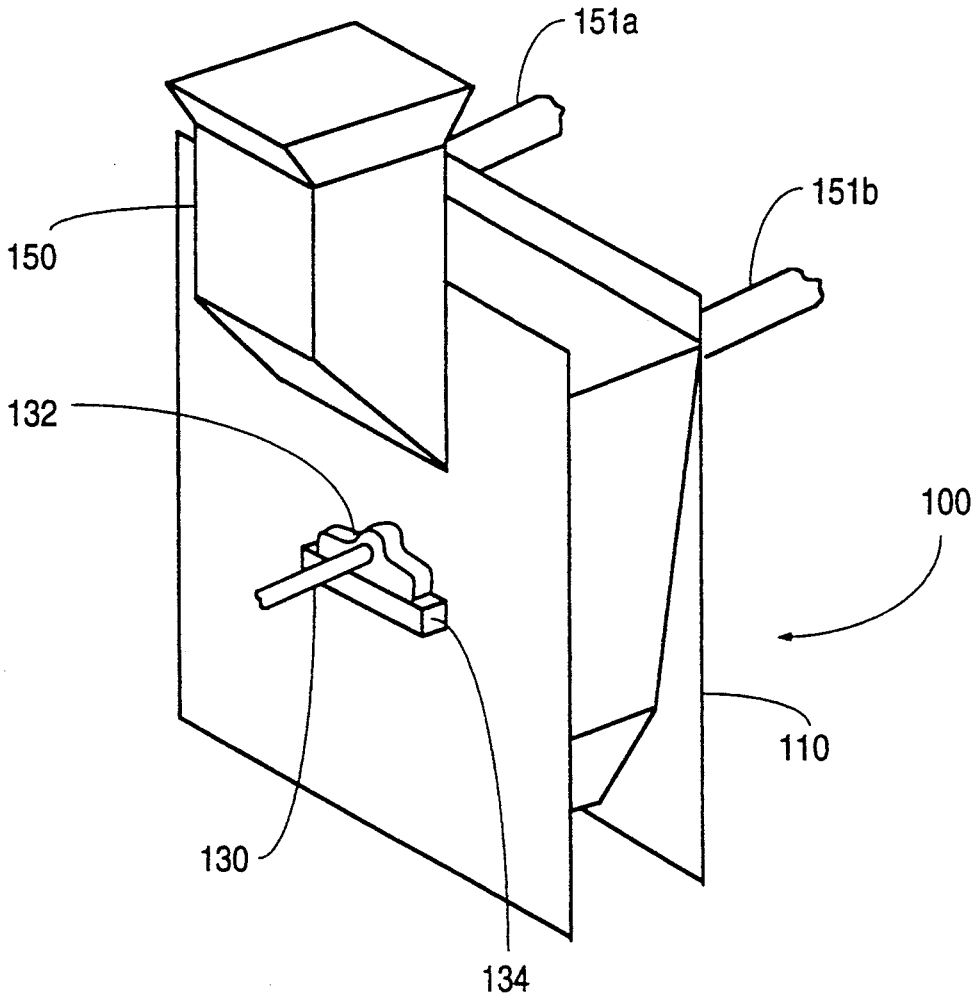
FIG. 1 is a perspective view of a rotary collider mill according to an embodiment of the invention to which is connected an inlet collector and discharge tubes.

FIG. 1 is a perspective view of one embodiment of a rotary collider mill 100 according to the invention to which is attached an inlet collector 150 and two discharge tubes 151*a* and 151*b*. The rotary collider mill 100 may be used for a variety of applications in which it is desired to crush one or more objects into smaller objects. For instance, the rotary collider mill 100 can be used for ore crushing in mining operations, glass crushing in glass recycling, feed milling, and wet milling for applications such as producing coal slurry.

In the following description of embodiments of the invention, the magnitudes of certain dimensions are specified. It is to be understood that these dimensions are merely illustrative. The invention is broad enough to encompass rotary collider mills having dimensions with magnitudes other than those specified. In particular, rotary collider mills according to the invention may be formed in which all of the dimensions are proportionately increased or decreased with respect to the dimensions given below.

The rotary collider mill 100 comprises a canister 110, impeller (not shown) and shaft 130. The shaft 130 extends through the canister 110 and is rotatably supported by a first bearing 132 mounted on a bearing platform 134 located on one side of the canister 110 and a second bearing (not shown) mounted on a bearing platform (not shown) located on the other side of the canister 110. The impeller is mounted on the shaft 130 within the canister 110.

An inlet collector 150 is attached to the canister 110 over an inlet port (not shown) formed through one side of the canister 110. Two outlet ports (not shown) are formed through the side of the canister 110 opposite the side through which the inlet port is formed. Discharge tubes 151*a* and 151*b* are attached to the canister 110 over the outlet ports for aid in removal of objects from the canister 110.

During operation of the rotary collider mill 100, the shaft 130 is driven to rotate. Inside the canister 110, the impeller rotates with the shaft 130. As the shaft 130 and impeller rotate, objects to be crushed are fed into the canister 110 interior through the inlet port. The objects are crushed by contact with the impeller, interior walls of the canister 110, and/or contact with other objects inside the canister 110. The objects are crushed until they are small enough to be forced out of one of the outlet ports by the pressure distribution within the canister 110.

When objects first enter the canister 110 they contact the impeller paddle support (described in more detail below). Generally, this first impact breaks the objects into smaller objects. These smaller objects are propelled vigorously around the canister 110 by the airflow resulting from the rotation of the impeller within the canister 110. This vigorous motion of the objects results in a large number of collisions between objects within the canister 110. Thus, objects within the canister are crushed extensively by other objects within the canister. A large portion of the crushing by the rotary collider mill 100 is performed without contact between the objects and any portion of the rotary collider mill 100 (i.e., the canister 110 interior walls or impeller). Consequently, objects can be crushed to a very small size without a large amount of wear being inflicted on the rotary collider mill 100.

FIGS. 2A–2E are a first side view, a second side view, a third side view, a top view and a bottom view, respectively, of the rotary collider mill 100.

Figure 2B:
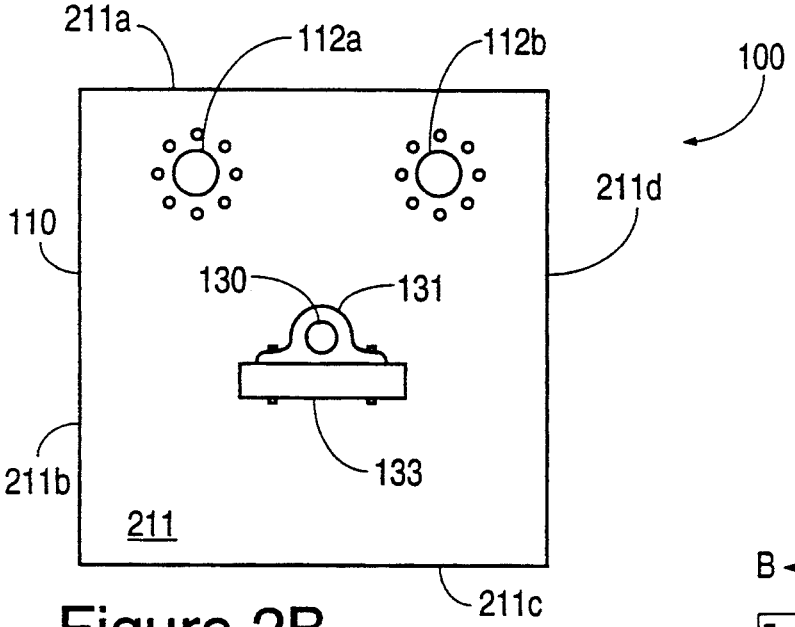
FIG. 2B is a second side view of the rotary collider mill of FIG. 1.
Figure 2C:
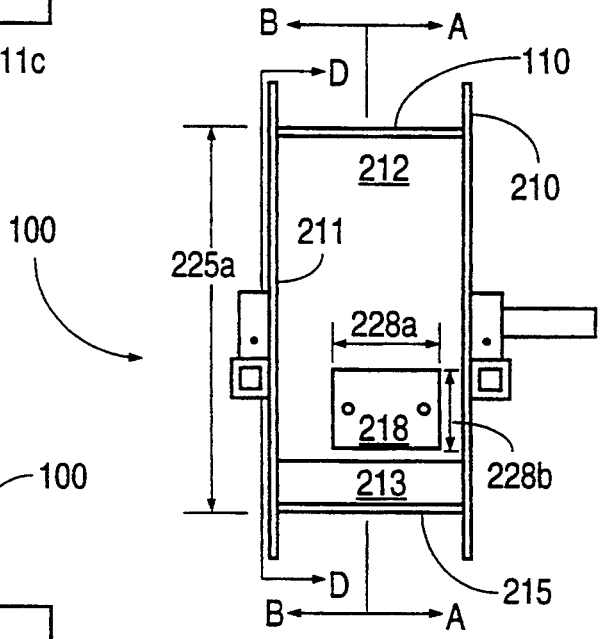
FIG. 2C is a third side view of the rotary collider mill of FIG. 1.
Figure 2A:
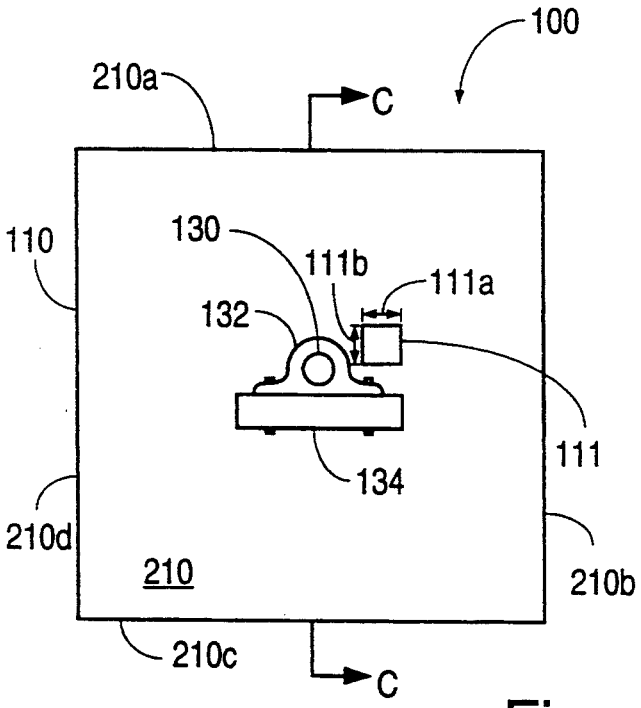
FIG. 2A is a first side view of the rotary collider mill of FIG. 1.

FIG. 2A is a first side view of the rotary collider mill 100 showing side plate 210 of the canister 110. The side plate 210 is square: each edge 210*a*, 210*b*, 210*c*, 210*d* is 48 inches in length.

The inlet port 111 is rectangular and extends through side plate 210 to the canister 110 interior. The dimension 111*a* of the inlet port 111 is 7 inches and the dimension 111*b* is 8 inches. The center of the inlet port 111 is 20 inches from the edge 210*a* and 17.5 inches from the edge 210*b*. The inlet port 111 could have other than a rectangular shape (e.g., circular). The dimensions and location of the inlet port 111 could also be varied from the dimensions and location described.

Adjacent the side plate 210, the shaft 130 is mounted in a high speed bearing 132 such as a pillow block bearing. The bearing 132 is mounted on a bearing platform 134. The bearing 132 is attached to the bearing platform 134 by any suitable method. Illustratively, the bearing 132 is bolted to the bearing platform 134. The bearing platform 134 is attached to the side plate 210 by any suitable method. Illustratively, the bearing platform 134 is welded to the side plate 210.

The nominal inner diameter of the bearing 132 and outer diameter of the shaft 130 is 3 inches. The longitudinal axis of symmetry of the shaft 130 is located 23.5 inches from the edge 210*a* and 24 inches from the edge 210*b*. The axis of symmetry of the shaft 130 could be located at other distances from the edges 210*a* and 210*b*. As will be explained in more detail below, the location of the shaft 130 is specified so that there will be a larger clearance between the impeller and the top of the canister 110 interior than between the impeller and the bottom of the canister 110 interior.

FIG. 2B is a second side view of the rotary collider mill 100 showing side plate 211 of the canister 110. The side plate 211 is square: each edge 211*a*, 211*b*, 211*c*, 211*d* is 48 inches in length.

Two circular outlet ports 112*a* and 112*b* extend through the side plate 211 to the canister 110 interior. The outlet ports 112*a*, 112*b* each have a diameter of 6 inches. The center of the outlet port 112*a* is 7 inches from the edge 211*a* and 5.5 inches from the edge 211*b*. The center of the outlet port 112*b* is 7 inches from the edge 211*a* and 5.5 inches from the edge 211*d*.

Adjacent the side plate 211, the shaft 130 is mounted in a high speed bearing 131 such as a pillow block bearing. The bearing 131 is attached to a bearing platform 133 and the bearing platform 133 is attached to the side plate 211 in the same manner as described with respect to FIG. 2A. The nominal inner diameter of the bearing 131 is 3 inches.

FIG. 2C is a third side view of the rotary collider mill 100 showing first bottom plate 212, second bottom plate 213, and third bottom plate 215 of the canister 110. The dimension 225*a* is 39 inches. First bottom plate 212, second bottom plate 213, and third bottom plate 215, are perpendicular to and separate side plates 210 and 211.

A rectangular hole is formed in the first bottom plate 212 and covered with a rectangular inspection plate 218. The inspection plate 218 may be attached to the first bottom plate 212 by, for instance, screws, or nuts and bolts. The dimensions 228*a* and 228*b* of the inspection plate 218 are each 6 inches. The inspection plate 218 is preferably formed with a protruding section that fits into the hole formed in the first bottom plate 212 such that the protruding section and the interior of the first bottom plate 212 provide a substantially continuous wall inside the canister 110.

In FIG. 2C, the inspection plate 218 and associated hole in first bottom plate 212 are both rectangular. However, the inspection plate 218 and hole could both be any other shape (e.g., circular), and one may have a different shape than the other. The only requirement is that the inspection plate 218 cover the hole in the first bottom plate 212.

The inspection plate 218 serves two purposes. First, the inspection plate 218 can be removed from the canister 110, and the interior surface of the inspection plate 218 examined for evidence of wear. In this way, the amount of wear on the interior surfaces of the canister 110 can be monitored without disassembling the entire canister 110.

Second, the inspection plate 218 can be removed to allow the removal of crushed objects from the interior of the canister 110. This would be necessary if, for instance, the rotary collider mill 100 overloaded and was shut down (either automatically or manually) to prevent damage to the rotary collider mill 100. Again, rather than disassembling the canister 110, it is easier to remove the inspection plate 218 to allow removal of objects from the canister 110.

Figure 2D:
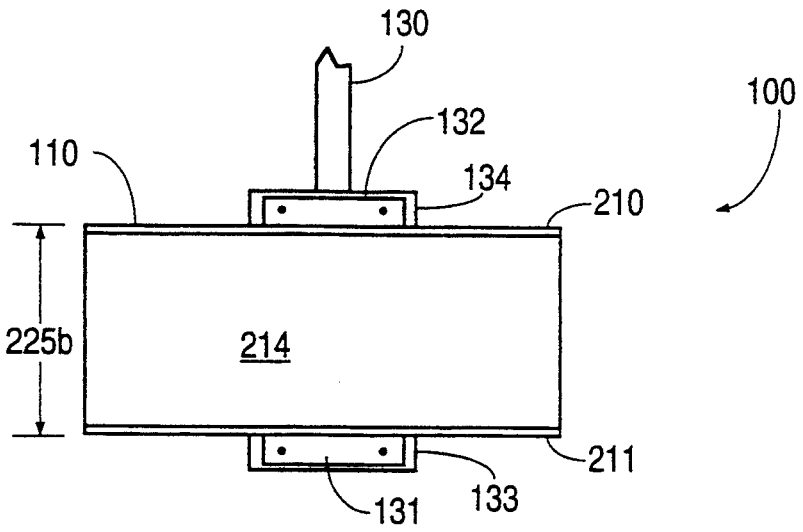
FIG. 2D is a top view of the rotary collider mill of FIG. 1.

FIG. 2D is a top view of the rotary collider mill 100 showing top plate 214 of the canister 110. The dimension 225*b* is 18.5 inches. Top plate 214 is perpendicular to and separates side plates 210 and 211.

Figure 2E:
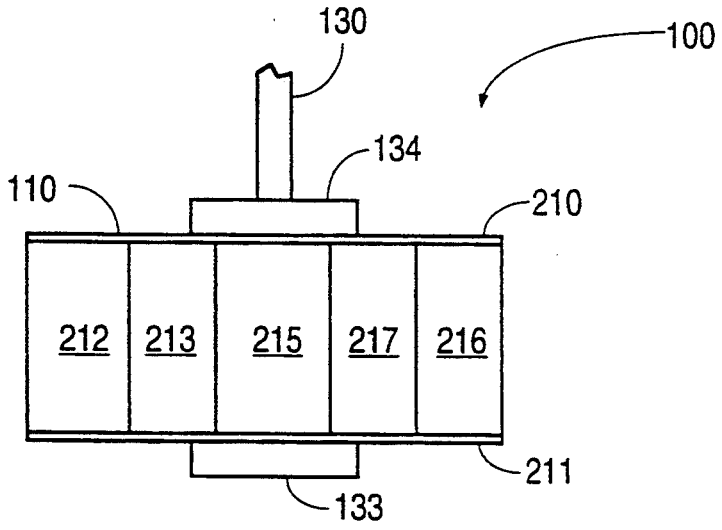
FIG. 2E is a bottom view of the rotary collider mill of FIG. 1.

FIG. 2E is a bottom view of the rotary collider mill 100 showing first bottom plate 212, second bottom plate 213, third bottom plate 215, fourth bottom plate 216 and fifth bottom plate 217. Fourth and fifth bottom plates 216 and 217 are identical to first and second bottom plates 212 and 213, respectively. Fourth bottom plate 216 and fifth bottom plate 217 are perpendicular to and separate side plates 210 and 211.

The side plates 210 and 211 are each 0.375 inches thick. The top plate 214 and bottom plates 212, 213, 215, 216 and 217 are each 0.75 inches thick. All of the plates 210, 211, 212, 213, 214, 215, 216 and 217 are made of, for instance, mild steel.

Figure 3A:
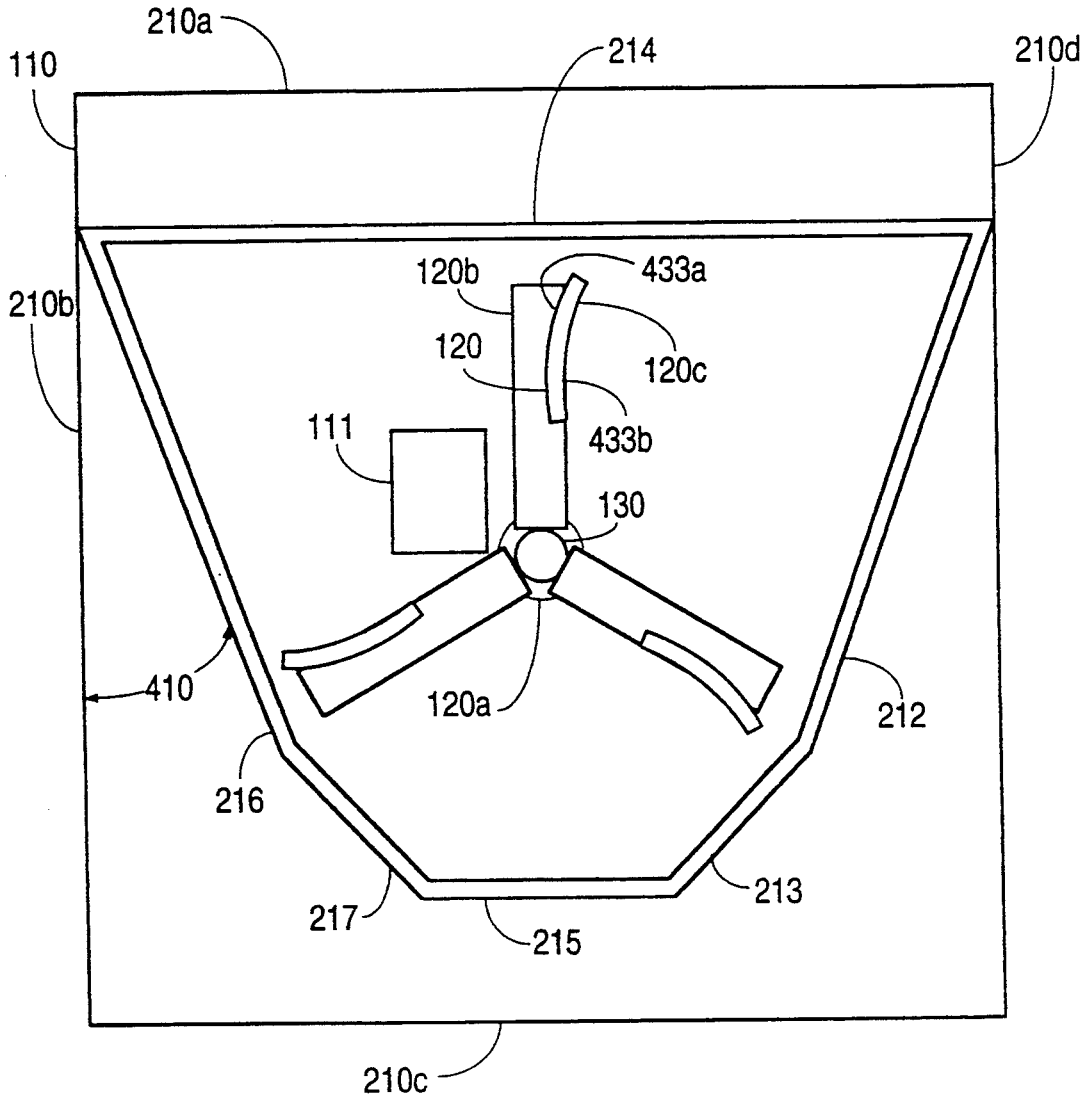
FIG. 3A is a cross-sectional view, taken along section A—A of FIG. 2C, of the rotary collider mill of FIG. 1.
Figure 3B:
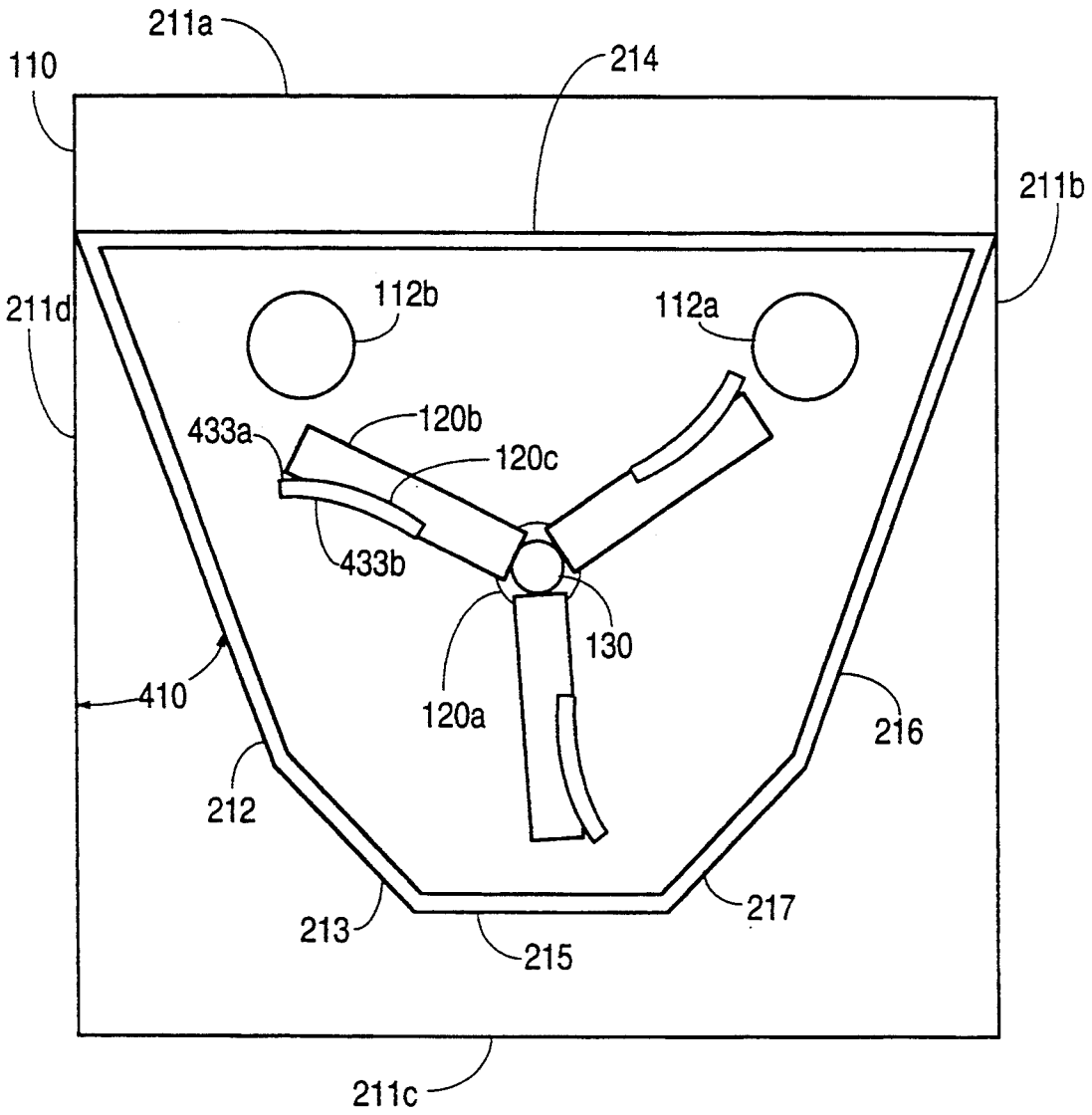
FIG. 3B is a cross-sectional view, taken along section B—B of FIG. 2C, of the rotary collider mill of FIG. 1.
Figure 3C:
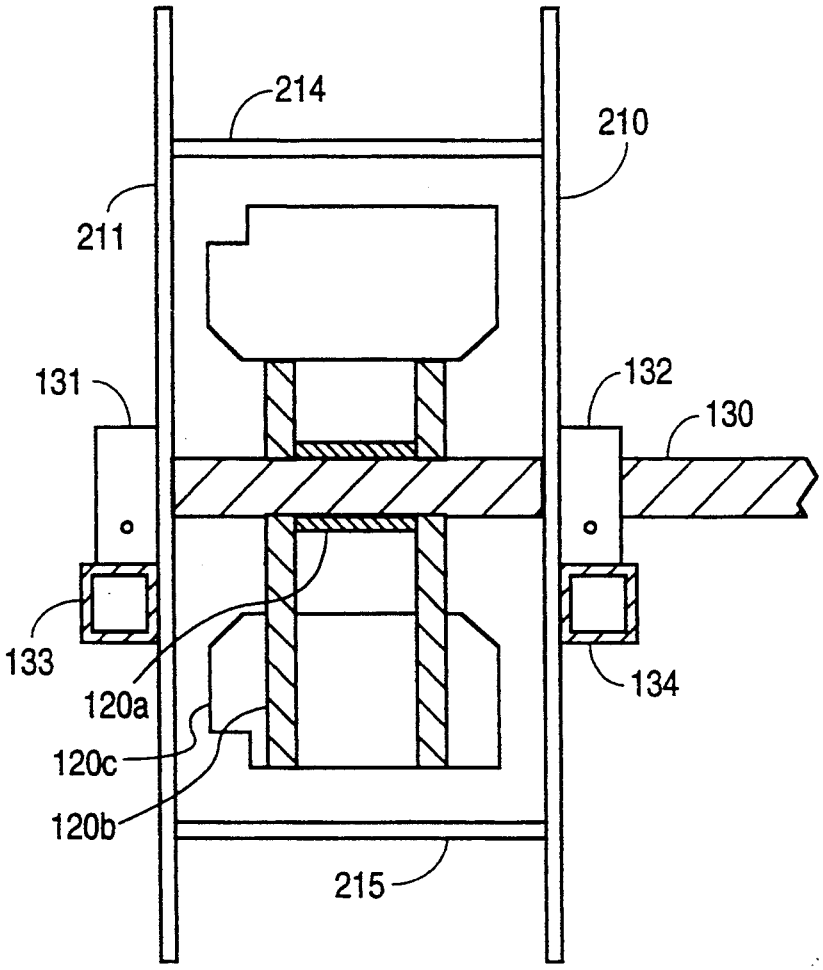
FIG. 3C is a cross-sectional view, taken along section C—C of FIG. 2A, of the rotary collider mill of FIG. 1.

FIG. 3A is a cross-sectional view, taken along section A—A of FIG. 2C, of the rotary collider mill 100 of FIG. 1. FIG. 3B is a cross-sectional view, taken along section B—B of FIG. 2C, of the rotary collider mill 100 of FIG. 1. FIG. 3C is a cross-sectional view, taken along section C—C of FIG. 2A, of the rotary collider mill 100 of FIG. 1.

FIGS. 3A, 3B and 3C show the canister 110 interior in which impeller 120 is disposed. The impeller 120 comprises a cylindrical collar 120*a* and three blades, each blade comprising a pair of paddle supports 120*b* and a paddle 120*c*. The collar 120*a*, paddle supports 120*b* and paddles 120*c* are all made of, for instance, mild steel. Other steels could be used so long as they are not susceptible to brittle fracture.

The collar 120*a* is welded to the shaft 130. One end of each of the paddle supports 120*b* is cut out with a torch, rounded and welded to the shaft 130. The collar 120*a* extends between each of the pairs of paddle supports 120*b* and is welded to each of the paddle supports 120*b*. The collar 120*a* provides a stronger attachment of the impeller 120 to the shaft 130 than would be the case if the impeller 120 was attached to the shaft 130 only at the ends of the paddle supports 120*b*. Each of the paddles 120*c* is attached to one of the pairs of paddle supports 120*b* at ends of the pair of paddle supports 120*b* opposite the ends attached to the shaft 130. The paddles 120care welded to the paddle supports 120*b*. The impeller blades (paddles 120*c* and associated pair of paddle supports 120*b*) are equidistant from each other around the circumference of the shaft 130, i.e., the blades are 120° apart. (Note that two blades are shown opposite each other in FIG. 3C, i.e., 180° apart. This is done to enhance illustration of the impeller 120; FIG. 3C does not illustrate the actual configuration of the blades of the impeller 120.) In the above description, components of the impeller 120 are attached to the shaft 130 and each other by welding; it is to be understood that other appropriate methods of attachment could be used.

Viewed in the plane of FIGS. 3A and 3B, the length of the first bottom plate 212 is 30.75 inches, the length of the second bottom plate 213 is 13 inches, the length of the third bottom plate 215 is 15 inches, the length of the fourth bottom plate 216 is 30.75 inches, and the length of the fifth bottom plate 217 is 13 inches. As previously noted, the length of the top plate 214 is 48 inches.

Figure 4A:
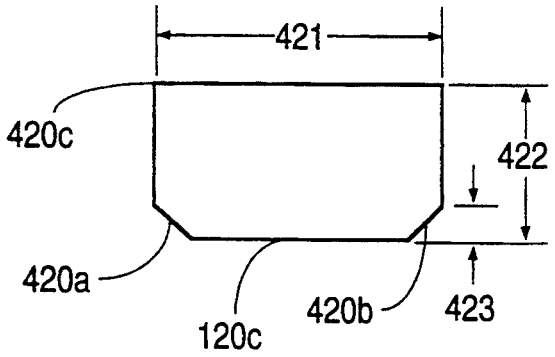
FIG. 4A is a plan view of an impeller paddle for use in the rotary collider mill of FIG. 1.

FIG. 4A is a plan view of impeller paddle 120*c* without a rectangular notch cut out at corner 420*c* (see FIG. 3C), as described below. The dimension 421 is 15.75 inches and the dimension 422 is 9 inches. The two corners 420*a* and 420*b* of impeller paddle 120*c* that are nearest the paddle supports 120*b* are beveled at a 45° angle. The dimension 423 is 2 inches.

Figure 4B:
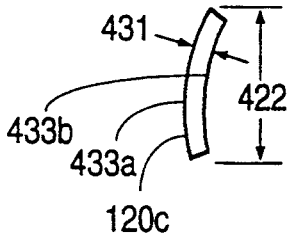
FIG. 4B is a cross-sectional view of the impeller paddle of FIG. 4A.

FIG. 4B is a cross-sectional view of impeller paddle 120*c*. The thickness 431 of the impeller paddle 120*c* is 1 inch. The radius of curvature of the impeller paddle 120*c*, measured at the surface 433*a*, is 7.5 inches.

During operation of the rotary collider mill 100, the shaft 130 is driven to rotate so that the surface 433*b* of each of the paddles 120*c*faces into the airflow. Thus, as viewed in FIG. 3A, the shaft 130 rotates in a clockwise direction; as viewed in FIG. 3B, the shaft 130 rotates in a counterclockwise direction.

The shaft 130 may be driven to rotate by any appropriate power source such as a gasoline, diesel or electric engine that can maintain the desired shaft speed while the rotary collider mill 100 is crushing objects. The rotary collider mill 100 has been operated at speeds ranging from 880 to 4250 rpm. However, preferably, the shaft speed is maintained between 1750 and 2250 rpm. Illustratively, the shaft 130 is driven by a 60 horsepower electric engine. Since the drive shaft of the engine driving the shaft 130 may be smaller than the shaft 130, a conventional coupler can be fitted on the shaft 130 to allow mating between the differently sized drive shaft and shaft 130.

As the shaft 130 rotates, the impeller 120 rotates with the shaft 130 inside the canister 110. Objects are introduced into the canister 110 through the inlet port 111. Immediately after entering the canister 110, the objects strike one of the paddle supports 120*b* and break into pieces. These smaller pieces are then propelled around the canister 110 against the canister 110 interior walls, the impeller 120, and other objects. In particular, the rotary collider mill 100 results in a large amount of self-crushing by the objects within the canister 110 (i.e., collisions between objects) as compared to previous mills. Because a large amount of the crushing is done without contact with the canister 110 interior walls or impeller 120, a relatively small amount of wear is inflicted on the canister 110 interior walls and impeller 120 during use of the rotary collider mill 100.

The rotation of the impeller 120 causes motion of the air inside the canister 110. The high velocities within the canister 110 cause the objects in the canister 110 to impact each other, the impeller paddles 120*c* and the canister 110 interior walls vigorously and often, so that the objects are quickly crushed extensively. As best as is understood, rotation of the impeller 120 causes an airflow inside the canister 110 that is similar to that found in a hurricane. In the plane of FIGS. 3A and 3B, a vortical airflow arises inside the canister 110. In the region of the canister 110 interior near the shaft 130, the speed of the air is relatively low (as in a hurricane). Moving radially outward from the shaft 130, the rotational speed of the vortical airflow increases (again, as in a hurricane). Consequently, the static pressure near the shaft 130 is relatively high while the static pressure at the edges of the canister 110 distant from the shaft 130 is relatively low. Thus, a net force exists that tends to move objects from the center of the canister 110 near the shaft 130 to the edges of the canister 110. Additionally, air is drawn into the interior of the canister 110 through the inlet port 111 as a result of the rotation of the impeller 120.

Some of the objects are forced out of the canister 110 by an impact which directs the object through one of the outlet ports 112*a* or 112*b*. However, generally, objects are crushed until they are small enough to be forced out of one of the outlet ports 112*a* or 112*b* by the pressure gradient which exists within the canister 110. Since most of the objects are discharged when they reach a certain size, the discharged objects are relatively uniform in size, in contrast to previous mills.

Though not readily apparent from FIGS. 2A–2E, there is a gap between each of the bearings 131 and 132 and the corresponding side plate 210 or 211. Since the shaft 130 must rotate, there is also a gap between the shaft 130 and each of the side plates 210 and 211 where the shaft 130 enters the canister 110. Intentionally, these gaps are left unsealed. When the rotary collider mill 100 begins to overload (i.e., when the canister 110 begins to fill with more objects than can be crushed at one time), some of the objects will begin to spill out through the gaps between the shaft 130 and side plates 210 and 211 into the gaps between each of the bearings 131 and 132 and the corresponding side plates 210 and 211. When this happens, appropriate modification can be made to the operation of the rotary collider mill 100 to alleviate overloading that may damage the rotary collider mill 100. For instance, the input of objects into the canister 110 may be reduced to decrease the load on the rotary collider mill 100, or the shaft 130 rotational speed may be increased so that the rotary collider mill 100 can process a larger load.

As seen in FIG. 2A, the inlet port 111 is formed in the side plate 210 near the location at which the shaft 130 enters the canister 110 through side plate 210. As seen in FIG. 2B, the outlet ports 112*a*, 112*b*, on the other hand, are formed in the side plate 211 (which is opposite the plate 210) at locations distant from the location at which the shaft 130 enters the canister 110 through side plate 211. Placement of an inlet port (or ports) and outlet ports (or port) in this manner has been found to yield optimum performance of the rotary collider mill 100.

The inlet port 111 and outlet ports 112*a*, 112*b* of the rotary collider mill 100 are placed so as to maximize the minimum amount of distance that an object must travel before the object can exit the canister 110. As described above, the operation of the rotary collider mill 100 is understood to provide a vortical airflow inside the canister 110 that gives rise to a pressure distribution that forces objects from the center of the canister 110 interior to the periphery of the canister 110 interior. With this understanding, if, for instance, the inlet port 111 was formed in the canister 110 so that objects enter the canister 110 near the periphery of the canister 110 interior, and the outlet ports 112*a*, 112*b* were formed in the canister 110 so that objects exit the canister 110 near the shaft 130, it would be expected that objects in the canister 110 would tend to remain near the periphery of the canister 110 interior rather than moving toward the center of the canister 110 and the outlet ports 112*a*, 112*b*, thus impeding the introduction of new objects into the canister 110. If both the inlet port 111 and outlet ports 112*a*, 112*b* were formed in the canister 110 so that objects enter and exit the canister 110 either near the periphery of the canister 110 or near the shaft 130, the objects would not have to travel across the space from the shaft 130 to the periphery of the canister 110 interior, thus reducing the amount of crushing that occurs. Further, in the latter case, since there is little air motion near the shaft 130, there would be little motion of the objects, resulting in insufficient crushing and, possibly, clogging of the canister 110.

Therefore, preferably, the inlet port 111 and outlet ports 112*a*, 112*b* are located so that objects enter the canister 110 near the shaft 130 and exit the canister 110 distant from the shaft 130. The pressure distribution within the canister 110 naturally forces the objects from the inlet ports 111 to the outlet ports 112*a*, 112*b*. This placement of inlet port 111 and outlet ports 112*a*, 112*b* necessitates that objects travel across the distance from the inner portion of the canister 110 interior near the shaft 130 to the periphery of the canister 110 interior.

Consequently, there is more motion of objects within the canister 110 and objects are crushed for a longer period of time, resulting in more complete and efficient crushing than would be the case if one of the alternative inlet/outlet port configurations described above was used.

According to the above principles, generally, the inlet port 111 is located as near as possible to the shaft hole in the side plate 210 and is made as large as possible without compromising the structural integrity of the canister 110. Further, the inlet port 111 is located, as much as possible, so that the inlet port 111 is inside of the arc of sweep of the end (inner end) of the paddles 120*c* near the shaft 130. If any portion of the inlet port 111 extends past approximately one third of the length (dimension 422 in FIG. 4A) of the paddles 120*c* (measured from the inner end of the paddles 120*c*), an airflow is generated out of the inlet port 111 which undesirably results in discharge of objects from the canister 110 through the inlet port 111.

Generally, the outlet ports 112*a*, 112*b* are located as far from the location of the shaft 130 as possible while remaining within the perimeter of the interior of the canister 110. Further, the outlet ports 112*a*, 112*b* are located, as much as possible, so that the outlet ports 112*a*, 112*b* are outside of the arc of sweep of the end (outer end) of the paddles 120*c* distant from the shaft 130. It has been found that if any portion of the outlet ports 112*a*, 112*b* is within the arc of sweep of the outer end of the paddles 120*c*, the size of the objects discharged from the canister 110 is undesirably large. Further, the impeller blades may impede discharge of objects through the outlet ports 112*a*, 112*b*. As can be appreciated from FIG. 3B, these constraints necessitate that the outlet ports 112*a*, 112*b* of the rotary collider mill 100 be located in the upper corners of the side plate 211 (just beneath the top plate 214).

The description so far of the inlet port 111 and outlet ports 112*a*, 112*b* has been premised on formation of the inlet port 111 in one side plate, e.g., side plate 210, and the formation of the outlet ports 112*a*, 112*b* in the opposite side plate, e.g., side plate 211. The inlet port 111 and outlet ports 112*a*, 112*b* could be formed in the same side plate 210 or 211. Preferably, however, the inlet port 111 and outlet ports 112*a*, 112*b* are formed in opposite side plates 210 and 211. This is so that objects must pass across the canister 110 before being discharged, thus ensuring more complete crushing than would occur if the inlet port 111 and the outlet ports 112*a*, 112*b* were in the same side plate, e.g., side plate 210.

The invention encompasses rotary collider mills in which more than one inlet port is provided, subject to the constraints, as above, that the location and size of the inlet ports minimize the amount by which the impeller paddles pass over the inlet ports as the impeller is rotated, and that the inlet pores not unacceptably weaken the canister. The invention also encompasses rotary collider mills in which one, three or more outlet ports are provided, subject to the above constraints that the outlet port or ports be located near the periphery of the canister interior, and that the outlet port or ports be sized so as to eliminate overlap of the outlet pore or ports with the arc of sweep of the outer end of the impeller paddles as the impeller is rotated.

The location of the inlet port 111 combined with the direction of rotation of the impeller 120, also affects the size of objects discharged from the canister 110. For the configuration of inlet port 111 and outlet ports 112*a*, 112*b* shown in FIGS. 3A and 3B, it was found during operation of the rotary collider mill 100 that, when the impeller 120 is rotated clockwise in FIG. 3A, the rotary collider mill 100 produces larger objects than when the impeller 120 is rotated counterclockwise in FIG. 3A (for input objects of approximately the same size). The combination of the inlet port 111 location and the counterclockwise rotation of the impeller 120 holds the objects in the canister 110 longer than when the impeller 120 is rotated clockwise, thereby crushing the objects for a longer period of time so that smaller objects are discharged from the canister 110.

Note that, with respect to the configuration shown in FIG. 3A (i.e., inlet port 111 located to the left of the shaft 130 and impeller 120 rotated clockwise), the same effect (i.e., relatively large output objects) can be obtained by relocating the inlet port 111 on the right side of the shaft 130 (in a location that mirrors the location shown in FIG. 3A) and rotating the impeller 120 in a counterclockwise direction. Relatively small objects are produced by the rotary collider mill 100 when the inlet port 111 is located to the left of the shaft 130 in FIG. 3A and the impeller 120 is rotated counterclockwise, or when the inlet port 111 is located to the right of the shaft 130 in FIG. 3A and the impeller 120 is rotated clockwise.

The location of the outlet ports 112*a*, 112*b* can also affect the size of objects discharged from the canister 110 (i.e., the length of time that objects are crushed inside the canister 110). If, for instance, only one outlet port, e.g., outlet port 112*a*, was formed in the canister 110, or if the locations of the outlet ports 112*a*, 112*b* were changed from that shown in FIG. 3B, the size of objects discharged from the canister 110 would be different (for the same inlet port 111 location and impeller 120 rotation direction) than for the canister 110 as shown in FIG. 3B.

In summary, in the first instance, the location of the inlet and outlet ports of a rotary collider mill according to the invention may be chosen so as to achieve a particular output object size. However, once the canister has been produced, for a given canister (i.e., location of inlet and outlet ports), the size of output objects can be changed by changing the direction of rotation of the impeller.

The inlet port 111 has a square shape. Generally, an inlet port or ports in a rotary collider mill according to the invention may have any shape (e.g., circular).

The outlet ports 112*a*, 112*b* have a circular shape. The circular shape was chosen so that wear resulting from impact against the edges of the outlet ports 112*a*, 112*b* of objects leaving the canister 110 would be evenly distributed around the circumference of the outlet ports 112*a*, 112*b*. If the outlet ports 112*a*, 112*b* have a shape that includes sharp angles (e.g., rectangular, hexagonal, etc.), wear is not evenly distributed around the circumference of the outlet ports 112*a*, 112*b*. This may result in pitting of the outlet ports 112*a*, 112*b* at the sharp-angled areas and degradation of the flow of objects out of the outlet ports 112*a*, 112*b*.

The vortical airflow within the canister 110 is enhanced by the fact that there is an open airspace between each pair of paddle supports 120*b*. The paddles 120*c* could have been supported on the shaft 130 with a single-piece paddle support in which the airspace between the paddle supports 120*b* is filled in with additional metal. While such a construction would provide additional surface with which to crush objects in the canister 110, the additional surface would have changed the airflow within the canister 110 (and thus the pressure distribution) so that objects would not be discharged as effectively from the outlet ports 112*a*, 112*b*.

The rotary collider mill 100 has an impeller 120 with three blades (each blade comprises a pair of paddle supports 120*b* and a paddle 120*c*). An impeller having three blades was found to provide the best performance of the rotary collider mill 100. With only two blades, the impeller was hard to balance when rotating. A four-bladed impeller was also difficult to balance, though not as difficult as the two-bladed impeller. Additionally, with a four-bladed impeller, objects do not discharge as readily from the canister 110. This aspect is exacerbated with impellers having even more blades.

As previously discussed with respect to FIG. 4A, the two corners 420*a*, 420*b* of each impeller paddle 120*c* that are nearest the paddle supports 120*b* are beveled at a 45° angle. This is done so that wear on the paddle 120*c* is reduced at the corners 420*a*, 420*b*. This is particularly important for the corner 420*b* near the inlet port 111 since the corner 420*b* will sustain a relatively large number of impacts because of proximity of the corner 420*b* to objects entering the canister 110.

In an alternative embodiment of the invention (shown in FIG. 3C), a rectangular notch is cut into a third corner 420*c* of impeller paddle 120*c*, distal from the paddle supports 120*b* and adjacent the side plate 211 in which the outlet ports 112*a*, 112*b* are located. The notch is provided so that as the paddles 120*c* pass by the outlet ports 112*a*, 112*b* there is more room for objects to accumulate as they are being discharged from the canister 110 than would otherwise be the case.

As shown in FIG. 4B, the impeller paddles 120*c* are curved. During rotation of the impeller 120, the concave side of the impeller 120 faces into the air flowing past the impeller 120. The radius of curvature, measured at the surface 433*a*, of each paddle 120*c* is 7.5 inches.

It was found that if the paddles 120*c* are made flat or have a radius of curvature greater than 7.5 inches, the rotary collider mill 100 does not crush objects as extensively as when the paddle curvature is approximately 7.5 inches. As a result, larger objects are discharged from the canister 110. If the radius of curvature is made smaller than 7.5 inches, smaller objects are discharged from the rotary collider mill 100. According to the invention, the impeller paddles 120*c* may have any desired curvature that produces crushed objects of a certain size and/or at a certain capacity.

Note that the effect of the curvature of the paddles 120*c* may be attenuated or augmented to some extent by varying the speed of rotation of the impeller 120. As the impeller 120 is rotated at a greater speed, the vortical velocity increases, yielding a larger pressure gradient so that objects are discharged in a shorter period of time from the canister 110. Since the objects spend a shorter period of time in the canister 110, they are not crushed as completely. The objects are also less uniform in size. However, the rotary collider mill 100 may process a larger quantity of objects in a given amount of time. Thus, increasing impeller 120 speed increases the size and reduces the uniformity of objects discharged from the canister 110, and increases capacity of the rotary collider mill 100.

In contrast, decreasing the speed of rotation of the impeller 120 yields a smaller pressure gradient. Objects spend a longer period of time in the canister 110 and are crushed more completely and uniformly. However, a smaller quantity of objects is processed. Thus, decreasing impeller 120 speed results in crushing objects more finely and uniformly, and reducing the capacity of the rotary collider mill 100.

An impeller 120 having paddles 120*c* with a relatively small radius of curvature and operating at a relatively low rate of speed will discharge the most finely crushed objects. An impeller 120 having paddles 120*c* with a relatively large radius of curvature and operating at a relatively low rate of speed, or having paddles 120*c* with a relatively small radius of curvature and operating at a relatively high rate of speed will discharge objects crushed to an intermediate degree. An impeller 120 having paddles 120*c* with a relatively large radius of curvature and operating at a relatively high rate of speed will discharge the most coarsely crushed objects. Note, however, that the curvature of the paddles 120*c* has a greater effect on the size of the crushed objects than does the speed of the impeller 120.

As can be seen in FIG. 3B, the paddles 120*c* are mounted at an angle with respect to a line extending radially from the shaft 130. The paddles 120*c* are angled so that the concave side of the paddles 120*c* faces slightly toward the shaft 130 of the canister 110. At the end of the paddle 120*c* that lies nearest the shaft 130, the paddle surface 433*b* is flush with the adjacent surface of the paddle support 120*b*. At the end of the paddle 120*c* distal from the shaft 130, the paddle surface 433*a* is 0.375 inches from the surface of the paddle support 120*b*. Angling the paddles 120*c* in this manner was found to cause objects to remain in the canister 110 longer so that the objects are crushed to a greater degree than would otherwise occur.

Different combinations of impeller 120 and canister 110 having different characteristics may be used for different applications. For instance, the impeller 120 and canister 110 have been used with great success to crush ore. An impeller with a dimension 422 (see FIGS. 4A and 4B) of 8 inches (i.e., one inch shorter than the impeller 120) works well in crushing glass when used with the canister 110. Using the smaller impeller, it was found that when bottles with caps and labels still attached were input into the canister 110, and a screen placed over the exit of the discharge tubes 151*a*, 151*b* attached to the outlet ports 112*a*, 112*b*, respectively, of the rotary collider mill 100, the bottle glass was crushed to a size fine enough to pass through the screen, while most of the bottle caps and labels were caught by the screen. This is an improvement over existing cage mills which crush the caps together with the glass so that the two are not separated, thus contaminating the crushed glass which is to be used in recycling to produce new glass.

The cross-sectional shape of the interior of the canister 110, as shown in FIGS. 3A and 3B, was found, after testing of numerous canister shapes, to be the shape that provided the greatest capacity (i.e., largest volume of material processed per unit time) of the rotary collider mill 100, all other things being equal.

The lower portion of the interior of the canister 110, bounded by the second, third and fifth bottom plates 213, 215, 217 and the lower sections of the first and fourth bottom plates 212 and 216, roughly approximates a circular contour, i.e., the arc swept by the outer ends of the paddles 120*c* when the impeller 120 rotates. The minimum clearance between the paddles 120*c* and the third bottom plate 215 occurs at the midpoint of the third bottom plate 215 (as viewed in FIGS. 3A and 3B) and is 0.75 inches. The minimum clearance between the paddles 120*c* and each of the second and fifth bottom plates 213 and 217 is 0.75 inches. The minimum clearance between the paddles 120*c* and each of the first and fourth bottom plates 212 and 216 is 0.75 inches.

The upper portion of the interior of the canister 110 is bounded by the top plate 214 and the upper sections of the first and fourth bottom plates 212 and 216. The minimum clearance between the paddles 120*c* and the top plate 214 occurs at the midpoint of the top plate 214 (as viewed in FIGS. 3A and 3B) and is 2.75 inches. Note that this clearance is 2 inches greater than the 0.75 inch clearance between the third bottom plate 215 and the paddles 120*c*, i.e., the shaft 130 is located asymmetrically with respect to the top and bottom of the canister 110 interior.

Unlike the bottom portion of the interior of the canister 110, the upper portion of the interior of the canister 110 does not track the sweep of the impeller paddles 120*c*. Rather, the top plate 214 joins with each of the first and fourth bottom plates 212 and 216 to form a corner region on either side of the canister 110 having relatively large clearance between the paddles 120*c* and the canister 110 interior walls.

It was found that the optimum value for the angle 410 (FIGS. 3A and 3B) of the first and fourth bottom walls 212 and 216 with respect to the edges 210*d* and 210*b*, respectively, of the side plate 210 is approximately 9°. The value of the angle 410 cannot be made substantially larger than 9° without causing the first and fourth bottom plates 212 and 216 to interfere with the impeller 120. Lesser values of the angle 410 were found to yield rotary collider mills having less capacity than the rotary collider mill 100. Additionally, the rotary collider mill 100 having the angle 410 approximately equal to 9° was found to sustain less wear on the interior of the canister 110, than rotary collider mills having angles 410 with values less than 9°. The wear on these latter rotary collider mills was found to be greatest at the corners formed between the bottom plates 212 and 213, and 216 and 217, respectively.

As noted above, it is in the upper corner regions of the canister 110 interior that the outlet ports 112*a*, 112*b* are formed. The extra clearance between the top plate 214 and the paddles 120*c* (as compared to the clearance between the third bottom plate 215 and the paddles 120*c*) provides additional space in the upper corner regions so that larger outlet ports 112*a*, 112*b* can be formed. The additional space also provides more room for objects in the canister 110 to accumulate near the outlet ports 112*a*, 112*b* so that they can more readily be discharged from the canister 110.

Figure 5:
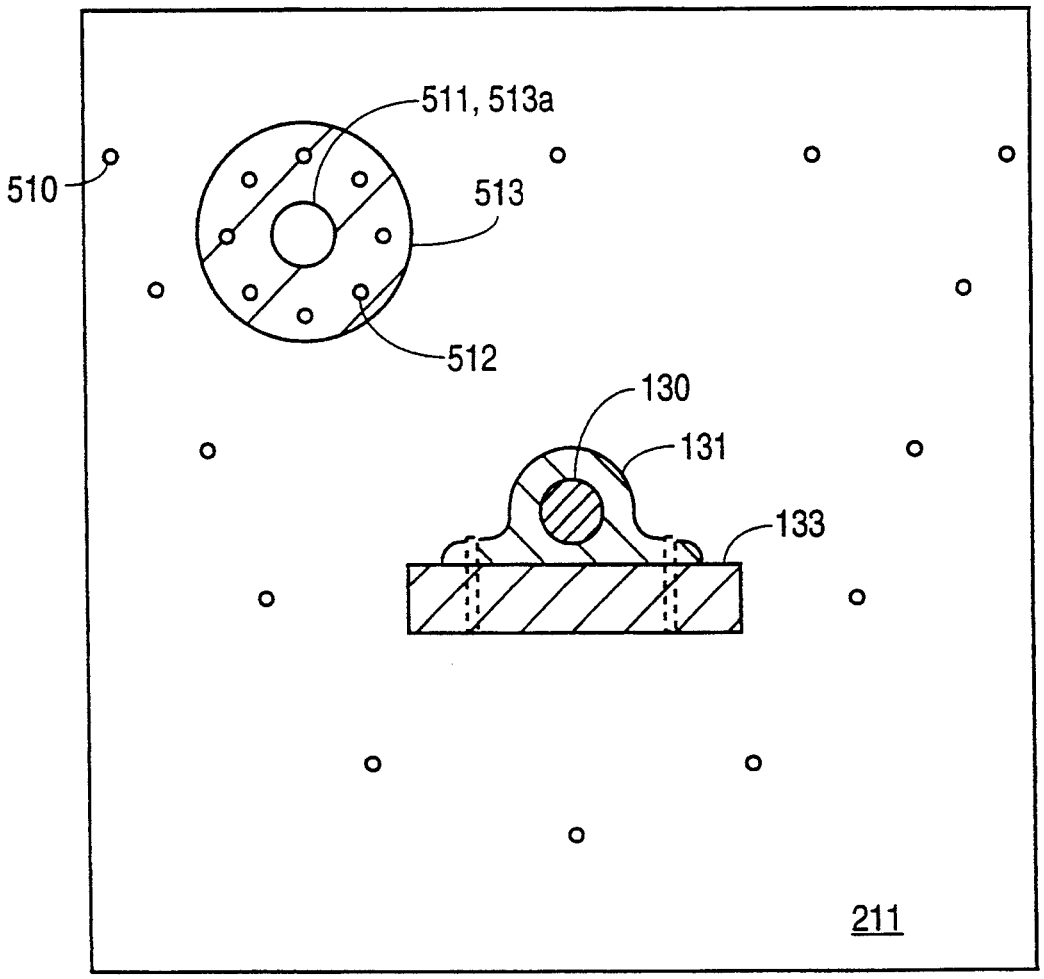
FIG. 5 is a cross-sectional view, taken along section D—D of FIG. 2C, of the rotary collider mill of FIG. 1.

FIG. 5 is a cross-sectional view, taken along section D—D of FIG. 2C, of the rotary collider mill 100 of FIG. 1. A plurality of holes 510 are shown formed through the side plate 211. The pattern of the holes 510 approximates the shape of the canister 110 as shown in FIGS. 3A and 3B. The holes 510 are used in attaching the side plate 211 to each of the plates 212, 213, 214, 215, 216 and 217. A corresponding set of holes are formed in the side plate 210 and are used in attaching the side plate 210 to an opposite side of the plates 212, 213, 214, 215, 216 and 217 to form the canister 110. The plates 210 and 211 may be attached to the plates 212, 213, 214, 215, 216 and 217 by, for instance, screws. Alternatively, the plates 210 and 211 could be welded to the plates 212, 213, 214, 215, 216 and 217.

After formation of the canister 110 as described above, preferably the canister 110 is cut with, for example, a blow torch to form an upper canister half and a lower canister half. The dividing line of the two halves is approximately at the center line of the shaft 130. A piece of angle iron is attached to the exterior of the side plate 210 on each of the upper and lower canister halves and to the exterior of the side plate 211 on each of the upper and lower canister halves. The two pieces of angle iron attached to each of the side plates 210 and 211 contact each other when the upper and lower canister halves are placed together. A plurality of holes are formed in each of the pieces of angle iron such that for each pair of pieces of angle iron on a given side of the canister 110, the holes are aligned with each other. Nuts and bolts are then used to connect each pair of pieces of angle iron on each side of the canister 110. This construction allows the canister 110 to be opened easily if it is necessary to, for instance, repair the impeller 120 or remove material from the interior of the canister 110.

The canister 110 may placed on the ground or a platform such that the third bottom plate 215 supports the canister 110. However, because of the shape of the bottom of the canister 110, without additional support, the rotary collider mill 100 is somewhat unstable in this position. To overcome this problem, the third bottom plate 215 may be attached to the surface of a platform. Alternatively, any of the other plates 210, 211, 212, 213, 214, 216 or 217 may be attached to another structure to provide stability to the rotary collider mill 100, or more than one of the plates 210, 211, 212, 213, 214, 215, 216 or 217 may be so attached. The attachment of one or more of the plates 210, 211, 212, 213, 214, 215, 216 or 217 to another structure or a platform may be accomplished by, for instance, welding.

The rotary collider mill 100 may also be mounted on another structure such as, for instance, a pair of I-beams or a platform, using the bearing platforms 133 and 134. The surface of each of the bearing platforms 133 and 134 that is opposite the surface on which the bearings 131 and 132, respectively, are mounted is mounted on a surface of the other structure. To provide added stability of the rotary collider mill 100, the bearing platforms 133 and 134 may be attached to the other structure by, for instance, welding.

Typically, discharge tubes 151*a*, 151*b* (FIG. 1) are attached to the canister 110 to facilitate the removal of objects away from the canister 110 after they have been discharged through the outlet ports 112*a*, 112*b*. In FIG. 5, a method of attachment of a discharge tube to the outlet port 112*a* is illustrated. A discharge tube is also attached to the outlet port 112*b* in the same manner as described below for the outlet port 112*a*; however, for clarity, this is not shown in FIG. 5. Eight bolt studs 512 are formed on the exterior surface of the side plate 211 around a hole 511 having a diameter of 6 inches. The bolt studs 512 are attached to the side plate 211 by, for instance, welding. A mounting flange 513 (shown in cross-section in FIG. 5) of discharge tube 151*a* is mounted on the bolt studs 512 and held in place with nuts. The mounting flange 513 has an outside diameter of 10 inches. The circular hole 513*a* formed in the flange 513 fits over the hole 511 and has a diameter of 6 inches.

It is to be understood that the attachment of the discharge tube 151*a* shown in FIG. 5A is merely illustrative of the methods possible. For instance, discharge tubes 151*a*, 151*b* having other than circular mounting flanges 513 can be used. The hole 511 could be larger than the hole 513*a*. The discharge tubes 151*a*, 151*b* could be attached by other methods, e.g., welding.

As with discharge tubes 151*a*, 151*b*, typically, a feeder 150 (FIG. 1) is attached to the canister 110 to facilitate introduction of objects into the canister 110 through the inlet port 111. The feeder 150 may be attached to the side plate 210 in a manner similar to the attachment of the discharge tubes 151*a*, 151*b* to the side plate 211.

Typically, the rotary collider mill 100 is used as part of a production process that includes an intermediate step of producing crushed objects. For instance, the rotary collider mill 100 could be used in a mining process in which the crushed objects are sent to a concentrator after being processed by the rotary collider mill 100. Generally, the rotary collider mill 100 discharges objects from the outlet ports 112*a*, 112*b* with sufficient force to deliver them directly to the next step in the production process, e.g., directly to a concentrator, without the addition of additional power.

The rotary collider mill 100 requires minimal maintenance. As previously discussed, because of the shape of the interior of the canister 110, there is very little wear on the sides of the canister 110. The impeller 120 also experiences minimal wear or fatigue. Normally, the canister 110 and impeller 120 should last for many years without requiring replacement or repair.

Another reason that the rotary collider mill 100 requires little maintenance is that it has only one moving part: the shaft 130. Typically, the first part associated with the rotary collider mill 100 to fail will be one of the bearings 131 or 132. Since the bearings 131, 132 are outside of the canister 110 (so that opening of the canister 110 is not required to replace bearing 131 or 132) and are attached to the bearing platforms 133, 134 only by nut and bolt combinations, the bearings 131, 132 may be replaced quickly and easily.

In some situations, it may be desirable to crush objects to a more uniform size than is possible with the rotary collider mill 100 as shown in FIG. 1. This is particularly so in many mining applications. To overcome the uniformity limitations of the rotary collider mill 100, it is possible to add a remill circuit to the rotary collider mill 100. The remill circuit allows objects that have not been crushed to a certain maximum allowable size to be reintroduced into the canister 110 over and over again until they are crushed to the desired size.

Figure 6A:
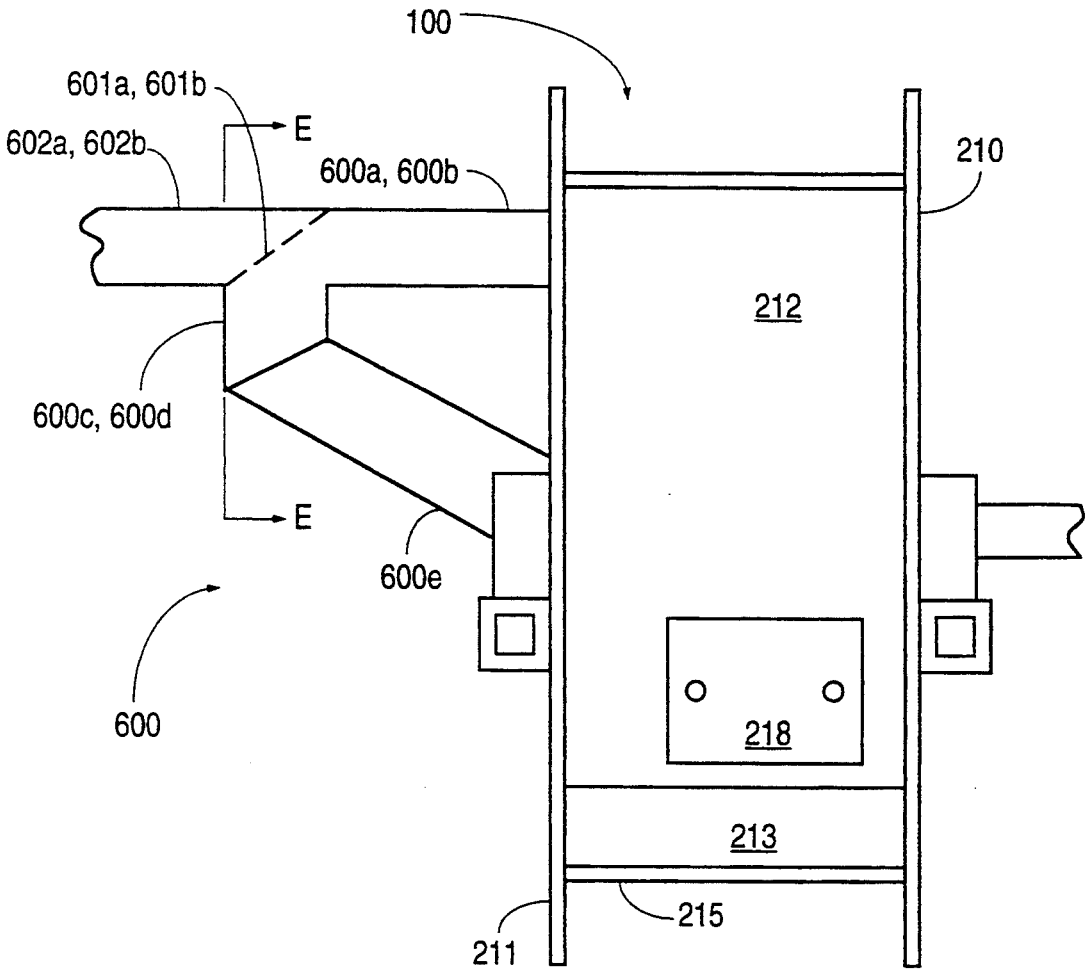
FIG. 6A is a side view of the rotary collider mill of FIG. 1 to which a remill circuit has been added.
Figure 6B:
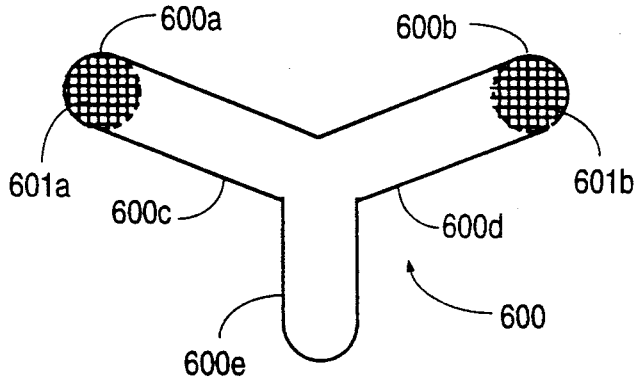
FIG. 6B is a cross-sectional view, taken along section E—E of FIG. 6A, of the remill circuit of FIG. 6A.

FIG. 6A is a side view of the rotary collider mill 100 to which a remill circuit 600 has been added. FIG. 6B is a cross-sectional view, taken along section E—E of FIG. 6A, of the remill circuit 600 of FIG. 6A.

The remill circuit 600 comprises five pipe sections 600*a*, 600*b*, 600*c*, 600*d*, 600*e*. The pipe sections 600*a*, and 600*b* are attached to the exterior surface of the side plate 211 at the location of the outlet ports 112*a*, 112*b*. Objects discharged from the canister 110 pass through the pipe sections 600*a*, 600*b* until they reach screens 601*a* and 601*b* disposed across the pipe sections 600*a* and 600*b*, respectively. The screens 601*a*, 601*b* are formed so that only objects smaller than a predetermined maximum size may pass through the screens 601*a*, 601*b* and be accumulated as crushed objects. Objects that cannot pass through the screens 601*a*, 601*b* are forced into the pipe sections 600*c* and 600*d*, respectively, which are formed integrally with the pipe sections 600*a* and 600*b*, respectively. The pipe sections 600*c* and 600*d* extend downward and toward each other, joining at one end of pipe section 600*e*. The other end of pipe section 600*e* is attached to a remill inlet (not shown) formed in the side plate 211 of the canister 110. Objects that did not pass through the screens 601*a*, 601*b*, pass through the pipe sections 600*c*, 600*d*, through pipe section 600*e*, and into the canister 110. The objects are crushed and discharged out of the outlet ports 112*a*, 112*b*, whereupon they may be passed through the screens 601*a*, 601*b* or directed back into the remill circuit 600.

The rotary collider mill 100 can be used for a variety of applications. Generally, the rotary collider mill 100 can be used to crush dry objects to produce smaller dry objects, dry objects to produce (with the addition of water) smaller wet objects, or wet objects to produce smaller wet objects. The crushed wet objects can be produced from dry objects by forming an additional port in the canister 110 of the rotary collider mill 100 and attaching a tube through which water is introduced into the canister 110 at a desired flow rate.

Various embodiments of the invention have been described. The descriptions are intended to be illustrative, not limitative. Thus, it will be apparent to one skilled in the art that certain modifications may be made to the invention as described without departing from the scope of the claims set out below.

I claim:

1. An apparatus for breaking an object into a plurality of smaller objects, comprising:

a canister having formed therein at least one inlet port for feeding the object into the canister and at least one outlet port for discharging the plurality of smaller objects out of the canister;

an impeller, the impeller having at least one blade and being disposed within the canister so as to be rotatable about an axis of rotation; and means for rotating the impeller about the axis of rotation, wherein:

the at least one outlet port is formed in a side plate of the canister that is perpendicular to the axis of rotation of the impeller and wherein during rotation of the impeller, the point on the at least one blade of the impeller that is the greatest distance from the axis of rotation describes a path that, viewed in a direction parallel to the axis of rotation, defines a projected circle on an interior surface of the side plate; and the at least one outlet port is formed in the side plate such that the at least one outlet port lies entirely outside of the area of the projected circle.

2. An apparatus as in claim 1, wherein a contour of the interior of the canister at an interior surface of the side plate comprises:

a first side adjacent the at least one outlet port;

a second side, a first end of the second side extending from a first end of the first side and forming an angle of less than 90° with the first side;

a third side, a first end of the third side extending from a second end of the first side and forming an angle of less than 90° with the first side;

a fourth side, a first end of the fourth side extending from a second end of the second side;

a fifth side, a first end of the fifth side extending from a second end of the third side; and a sixth side that is substantially parallel to the first side and extends between a second end of the fourth side and a second end of the fifth side.

3. An apparatus as in claim 2, wherein:

during rotation of the impeller, the point on the at least one blade of the impeller that is the greatest distance from the axis of rotation describes a path that, viewed in a direction parallel to the axis of rotation, defines a projected circle on the interior surface that lies entirely within the contour; and each of the smallest distances between the projected circle and the second, third, fourth, fifth and sixth sides, respectively, is smaller than the smallest distance between the projected circle and the first side.

4. An apparatus as in claim 3, wherein each of the smallest distances between the projected circle and the second, third, fourth, fifth and sixth sides, respectively, is at least 2 inches less than the smallest distance between the projected circle and the first side.

5. An apparatus as in claim 1, wherein a cross-sectional shape of the interior of the canister that is perpendicular to the axis of rotation is asymmetric with respect to the axis of rotation.

6. An apparatus as in claim 5, wherein:

during rotation of the impeller, the point on the at least one blade of the impeller that is the greatest distance from the axis of rotation describes a path that, viewed in a direction parallel to the axis of rotation, defines a projected circle on an interior surface of the side plate that lies entirely within a contour of the interior of the canister at the interior surface of the side plate; and the at least one outlet port is formed in the side plate such that the at least one outlet port lies entirely outside of the area of the projected circle.

7. An apparatus as in claim 1, wherein:

during rotation of the impeller, the point on the at least one blade of the impeller that is the smallest distance from the axis of rotation describes a path that, viewed in a direction parallel to the axis of rotation, defines a projected circle on an interior surface of the second side plate; and the at least one inlet port is formed in the first side plate such that the at least one inlet port lies entirely inside of the area of the projected circle.

8. An apparatus as in claim 7, wherein:

during rotation of the impeller, the point on the at least one blade of the impeller that is the greatest distance from the axis of rotation describes a path that, viewed in a direction parallel to the axis of rotation, defines a second projected circle on an interior surface of the first side plate; and the at least one outlet port is formed in the first side plate such that the at least one outlet port lies entirely outside of the area of the second projected circle.

9. An apparatus for breaking an object into a plurality of smaller objects, comprising:

a canister having formed therein an inlet port for feeding the object into the canister and an outlet port for discharging the plurality of smaller objects out of the canister;

an impeller, the impeller having at least one blade and being disposed within the canister; and a means for rotating the impeller, wherein:

a cross-sectional shape of the canister perpendicular to the axis of rotation of the impeller is asymmetric with respect to the axis of rotation of the impeller;

the at least one blade of the impeller describes a circle in the plane of the cross-sectional shape of the canister that lies entirely within the cross-sectional shape of the canister;

the area of the cross-sectional shape of the canister that lies outside of the circle and in the vicinity of the outlet port is substantially greater than other areas of the cross-sectional shape of the canister that lie outside of the circle; and the outlet port is formed in a side plate of the canister that is substantially parallel to the cross-sectional shape of the canister such that the area of the projection of the outlet port onto the plane of the cross-sectional area lies entirely outside of the area of the circle described by the at least one blade of the impeller.

10. An apparatus for breaking an object into a plurality of smaller objects, comprising:

a canister having formed therein an inlet port for feeding the object into the canister and an outlet port for discharging the plurality of smaller objects out of the canister;

an impeller, the impeller having at least one blade and being disposed within the canister; and a means for rotating the impeller, wherein:

a cross-sectional shape of the canister perpendicular to the axis of rotation of the impeller is asymmetric with respect to the axis of rotation of the impeller; and the cross-sectional shape of the canister comprises:

a first side adjacent the outlet port;

a second side, a first end of the second side extending from a first end of the first side and forming an angle of less than 90° with the first side;

a third side, a first end of the third side extending from a second end of the first side and forming an angle of less than 90° with the first side;

a fourth side, a first end of the fourth side extending from a second end of the second side;

a fifth side, a first end of the fifth side extending from a second end of the third side; and a sixth side that is substantially parallel to the first side and extends between a second end of the fourth side and a second end of the fifth side.

11. An apparatus as in claim 10, wherein:

the at least one blade of the impeller describes a circle in the plane of the cross-sectional shape of the canister that lies entirely within the cross-sectional shape of the canister; and each of the smallest distances between the circle and the second, third, fourth, fifth and sixth sides is smaller than the smallest distance between the circle and the first side.

12. An apparatus as in claim 11, wherein each of the smallest distances between the circle and the second, third, fourth, fifth and sixth sides is at least 2 inches less than the smallest distance between the circle and the first side.

13. An apparatus as in claim 10, wherein the angles between the first and second sides, and between the first and third sides each measure approximately 81°.

14. An apparatus for breaking an object into a plurality of smaller objects, comprising:

a canister having formed therein an inlet port for feeding the object into the canister and an outlet port for discharging the plurality of smaller objects out of the canister;

a shaft extending through the canister; and an impeller, the impeller having at least one blade and being disposed within the canister, each of the at least one blades comprising:

first and second paddle supports extending from the shaft; and a paddle attached to the first and second paddle supports, the paddle being curved so that the concave side of the paddle is rotated against the air in the canister, wherein:

the radius of curvature of a curved paddle surface is approximately 0.83 times the distance between the ends of the curved surface measured along a straight line between the ends.

15. An apparatus for breaking an object into a plurality of smaller objects, comprising:

a canister having formed therein an inlet port for feeding the object into the canister and an outlet port for discharging the plurality of smaller objects out of the canister;

a shaft extending through the canister; and an impeller, the impeller having at least one blade and being disposed within the canister, each of the at least one blades comprising:

first and second paddle supports extending from the shaft; and a paddle attached to the first and second paddle supports, the paddle being curved so that the concave side of the paddle is rotated against the air in the canister, wherein:

a cross-sectional shape of the canister perpendicular to the axis of rotation of the impeller is asymmetric with respect to the axis of rotation of the impeller; and the at least one blade of the impeller describes a circle in the plane of the cross-sectional shape of the canister that lies entirely within the cross-sectional shape of the canister; and the outlet port is formed in a side plate of the canister that is substantially parallel to the cross-sectional shape of the canister such that the area of the projection of the outlet port onto the plane of the cross-sectional area lies entirely outside of the area of the circle described by the at least one blade of the impeller.

16. An apparatus for breaking an object into a plurality of smaller objects, comprising:

a canister having an inlet port formed through a first side plate for feeding the object into the canister and an outlet port formed through a second side plate for discharging the plurality of smaller objects out of the canister, the first side plate being opposite the second side plate;

an impeller, the impeller having at least one blade and being disposed within the canister; and a means for rotating the impeller, wherein:

the cross-sectional shape of the canister perpendicular to the axis of rotation of the impeller is asymmetric with respect to the axis of rotation of the impeller;

the at least one blade of the impeller describes a circle in the plane of the cross-sectional shape of the canister that lies entirely within the cross-sectional shape of the canister; and the second side plate is substantially parallel to the cross-sectional shape of the canister such that the area of the projection of the outlet port onto the plane of the cross-sectional area lies entirely outside of the area of the circle described by the at least one blade of the impeller.

17. An apparatus for breaking an object into a plurality of smaller objects, comprising:

a canister having formed therein at least one inlet port for feeding the object into the canister and at least one outlet port for discharging the plurality of smaller objects out of the canister;

a shaft extending through the canister so as to be rotatable about an axis of rotation; and an impeller attached to the shaft within the canister and having at least one blade, the at least one blade comprising:

at least one paddle support extending from the shaft; and a curved paddle attached to an end of the at least one paddle support distal from the shaft, wherein:

a concave surface of the paddle is rotated against the air in the canister; and a first end of the paddle distal from the shaft extends further from an adjacent surface of the paddle support than a second end of the paddle proximal to the shaft; and further wherein the at least one outlet port is formed in a side plate of the canister that is perpendicular to the axis of rotation; and during rotation of the impeller, the point on the at least one blade of the impeller that is the greatest distance from the axis of rotation describes a path that, viewed in a direction parallel to the axis of rotation, defines a projected circle on an interior surface of the side plate; and the at least one outlet port is formed in the side plate such that the at least one outlet port lies entirely outside of the area of the projected circle.

18. An apparatus as in claim 17, wherein:

the at least one inlet port is formed in a side plate of the canister that is perpendicular to the axis of rotation;

during rotation of the impeller, the point on the at least one blade of the impeller that is the smallest distance from the axis of rotation describes a path that, viewed in a direction parallel to the axis of rotation, defines a projected circle on an interior surface of the side plate; and the at least one inlet port is formed in the second side plate such that the at least one inlet port lies entirely inside of the area of the projected circle.

19. An apparatus as in claim 17, wherein the center of the at least one inlet port is lower than the center of the at least one outlet port so that objects must move in opposition to the gravitational force in order to be discharged from the canister.

* * * * *